US006123253A

United States Patent [19]

Mehta et al.

[11] Patent Number: 6,123,253

[45] Date of Patent: Sep. 26, 2000

[54] BUSINESS FORM OR MAILER WITH CARBONLESS IMAGING

[75] Inventors: Rajendra Mehta; A. Dale Lakes; Hugh B. Skees, all of Dayton, Ohio

[73] Assignee: The Standard Register Company, Dayton, Ohio

[21] Appl. No.: 09/093,218

[22] Filed: Jun. 8, 1998

[51] Int. Cl.[7] ..... B65D 27/00

[52] U.S. Cl. ..... 229/92.1; 229/305

[58] Field of Search ..... 229/69, 70, 301, 229/92.1, 305

[56] References Cited

U.S. PATENT DOCUMENTS

| | | | |
|---|---|---|---|
| 4,729,506 | 3/1988 | Neubauer . | |
| 4,770,337 | 9/1988 | Leibe . | |
| 5,062,570 | 11/1991 | Ashby . | |
| 5,076,489 | 12/1991 | Steidinger . | |
| 5,110,043 | 5/1992 | Ashby . | |
| 5,127,879 | 7/1992 | Schubert . | |
| 5,137,494 | 8/1992 | Schubert et al. . | |
| 5,154,668 | 10/1992 | Schubert . | |
| 5,197,922 | 3/1993 | Schubert . | |
| 5,224,897 | 7/1993 | Linden et al. . | |
| 5,248,279 | 9/1993 | Linden et al. . | |
| 5,250,492 | 10/1993 | Dotson et al. . | |
| 5,288,014 | 2/1994 | Meyers et al. | 229/70 X |
| 5,294,041 | 3/1994 | Whiteside . | |
| 5,334,571 | 8/1994 | Baxter . | |
| 5,375,763 | 12/1994 | Sauerwine . | |
| 5,376,048 | 12/1994 | Whiteside . | |
| 5,393,265 | 2/1995 | Linden et al. . | |
| 5,418,205 | 5/1995 | Mehta et al. . | |
| 5,419,590 | 5/1995 | Rothschild . | |
| 5,429,298 | 7/1995 | Chess . | |
| 5,607,738 | 3/1997 | Bishop | 229/92.1 |
| 5,705,243 | 1/1998 | Mehta et al. | 229/92.1 X |
| 5,755,375 | 5/1998 | Rogers . | |

*Primary Examiner*—Jes F. Pascua
*Attorney, Agent, or Firm*—Killworth, Gottman, Hagan & Schaeff, LLP

[57] ABSTRACT

A business form or mailer intermediate providing fold-over carbonless imaging is provided. The form or mailer includes separate CB and CF coating portions on a single sheet. When the form or mailer is folded about a fold line, the CB portion comes in contact with the CF portion. An image is created when the fold-over carbonless area is subjected to an imaging force.

7 Claims, 12 Drawing Sheets

BUSINESS FORM OR MAILER WITH CARBONLESS IMAGING

BACKGROUND OF THE INVENTION

This invention relates to a business form and more, particularly, to a mailer in which carbonless imaging is utilized on multiple plies formed from the same sheet.

Mailer type business forms incorporating carbon transfer or carbonless imaging for transferring information printed on one part of a form to another part of the form are known. In a typical application, information is transferred from one ply to another when the plies are pressed together by a printer impact element. Computer automated mailing systems combine high speed variable printing capability with automated folding and sealing to mass produce mailers from sheet or roll stock business form intermediates. The widespread growth of these systems in recent years has led to the development of improved business form intermediates that can be printed in such automated systems. These automated printing systems can utilize a number of different printing technologies including laser, impact, ink jet, and thermal transfer. Laser printers are used most frequently.

Prior art mailers that provide imaging capability through the use of carbonless imaging typically form an image by means of CB and CF coated portions on adjacent plies formed by separate sheets. These mailers generally are not compatible with automated printing systems that typically utilize single ply intermediates. Accordingly, there is a need to provide business form intermediates that are compatible with laser printers (i.e., heat and pressure resistant) and also offer the benefits associated with fold-over carbonless imaging.

U.S. Pat. No. 5,062,570 to Ashby discloses a mailer product in which a self-contained carbonless patch is printed on a sheet which is then folded over in the final mailer. However, self-contained coatings are subject to premature coloration and usually are unsuitable for use in laser printers.

U.S. Pat. No. 5,110,043 to Ashby discloses a mailer in which adjacent plies formed by separate sheets have CB and CF coated portions. However, Ashby does not disclose both CB and CF coated on a single sheet, folded over in the mailer construction. Furthermore, the Ashby '043 mailer is limited to use with impact printing systems.

Accordingly, there is a need in the art for an improved business form incorporating the beneficial features of fold-over carbonless imaging especially for use with high speed non-impact printing systems.

SUMMARY OF THE INVENTION

This need is met by the present invention wherein an improved business form intermediate or mailer is provided. The mailer intermediate or form of the present invention incorporates fold-over carbonless imaging wherein CB and CF coatings are applied to separate portions of a single sheet in such a way that when the form is folded the two coatings come in contact. An image is formed when the area is subjected to an imaging force. The mailer or form of the present invention is uniquely suited for the automated high speed printing systems common today and provides enhanced utility to mailer forms.

In a first embodiment of the present invention, a business form or mailer intermediate is provided. The mailer or form comprises a substrate sheet having first and second faces, first and second parallel side edges and first and second opposite ends. At least first and second transverse fold lines are formed in the substrate perpendicular to the parallel side edges dividing the substrate into at least first, second and third panels.

A CB coating composition and a CF coating composition are provided on the first face in the first and second panels, respectively. When the substrate is folded about the fold line the CB coating composition comes in contact with the CF coating composition thereby creating an image transfer means capable of producing a copy when subjected to an imaging force. Variable and nonvariable information may be printed on first and second faces. Printing may be by means of any of various printing systems. The printing system used is preferably a high speed non-impact system such as laser or ink jet.

Longitudinal lines of weakness may be added adjacent to the first and second side edges to form marginal strips between the lines of weakness and the first and second side edges. Transverse lines of weakness ma be added adjacent to one or more of first and second end edges or first and second fold lines forming tear-off strip portions. The marginal strips and tear-off strip portions may be provided with adhesive for sealing the business form or intermediate into a C-fold mailer.

The business form according to this embodiment of the invention typically comprises an outgoing address area, a check, coupon or voucher portion and a detachable portion. The detachable portion utilizes the CB and CF coating compositions to yield an original signed article and a copy thereof. An address window may also be provided on one of the panels of the form.

According to another embodiment of the present invention, a business form or mailer is provided comprising a CF coating composition on the first panel and a CB coating composition on the second panel. The mailer is folded over in a Z-fold configuration and sealed along coordinating patterns of adhesive. The fold-over carbonless comprises an original and copy for ordering products by return mail.

According to yet another embodiment of the present invention, a business form comprising a C-fold configuration with a return envelope is provided further comprising a third fold line and a fourth panel. A CB coating composition and a CF coating composition separated by a fold line are disposed on the outside surface of the sealed mailer on the first and second panels, respectively. The recipient folds along the fold line bringing the CB coating composition in contact with the CF coating composition. The fold-over carbonless comprises an original return stub and a copy for use as a payment receipt. The return stub is returned with the recipient's payment in the return envelope formed from the third and fourth panels.

Longitudinal lines of weakness may be added adjacent to the first and second side edges to form marginal strips between the lines of weakness and the first and second side edges. An address window may also be formed in one of the first or second panels.

According to yet another embodiment of the present invention, a multi-ply mailer is provided comprising a first ply, a second ply, a first insert ply, and a fold-over insert ply. The first ply comprises an address area on a first face thereof. The second ply is attached to the first ply to form respective front and back sides of an outgoing mailer. The first insert ply is attached to the second ply. The first insert ply and the second ply are arranged and provided with adhesive strips such that, the second ply and the first insert ply form a return envelope. The fold-over insert is secured to the multi-ply mailer and comprises a substrate having first and second faces, a fold line across the substrate wherein the fold line separates the substrate into a first portion and a second portion, a CB coating composition on the first portion of the first face, and a CF coating composition on the second portion of the first face. The CB coating composition, the CF coating composition, and the fold line are positioned such that the CB coating composition contacts the CF coating composition when the substrate is folded about the fold line in a first direction. The multi-ply mailer may further comprising an image transfer composition on a second face of the first ply opposite the address area on the first face of the first ply.

The fold-over insert may be secured to the multi-ply mailer folded about the fold line in the first direction. The CB coating composition, the CF coating composition, and the fold line may be further positioned such that the CB coating composition avoids contact with the CF coating composition when the substrate is folded about the fold line in a second direction opposite the first direction, and the fold-over insert may be secured to the multi-ply mailer folded about the fold line in the second direction.

According to yet another embodiment of the present invention, a business form is provided comprising a substrate having first and second faces and a fold line across the substrate, wherein the fold line separates the substrate into a first portion and a second portion. A CB coating composition is provided on the first portion of the first face. A CF coating composition is provided on the second portion of the first face. An image medium is provided on the first portion of the first face, wherein the image medium and the CB coating occupy a common area of the first portion of the first face, and wherein the CB coating composition, the CF coating composition, the image medium, and the fold line are positioned such that the image medium is interposed between at least a portion of the CB coating composition and at least a portion of the CF coating composition when the substrate is folded about the fold line in a first direction. The image medium may be selected from the group consisting of a toner image, a carbon image, a laser image, and combinations thereof.

According to yet another embodiment of the present invention, a method of producing a business form is provided comprising the steps of: providing a substrate having first and second faces; forming a fold line across the substrate wherein the fold line separates the substrate into a first portion and a second portion; providing a CB coating composition on the first portion of the first face; providing a CF coating composition on the second portion of the first face; and providing an image medium on the first portion of the first face after the step of providing the CB coating composition on the first portion of the first face, wherein the image medium and the CB coating occupy a common area of the first portion of the first face, wherein the CB coating composition, the CF coating composition, and the fold line are positioned such that, upon folding the substrate about the fold line in a first direction, and upon introduction of an imaging force on the second face of the substrate, a duplicate image is formed in at least a portion of the CF coating composition on the second portion of the first face, and the common area of the first portion of the first face is positioned opposite at least a portion of the duplicate image on the second portion of the first face.

Accordingly, it is a feature of the present invention to provide a business form intermediate or mailer having features of fold-over carbonless imaging especially for use with high speed non-impact printing systems. These, and other features and advantages of the present invention will become apparent from the following detailed description, the accompanying drawings and the appended claims.

DETAILED DESCRIPTION OF THE PREFERRED EMBODIMENTS

The present invention provides an improved business form, such as for example a mailer, which incorporates fold-over carbonless imaging capabilities. The form or mailer of the present invention may be provided in single sheet or continuous web formats. The form or mailer of the present invention may be printed by means of automated printing systems such as laser, ink jet, thermal transfer, impact or various other printing systems. Furthermore, the form or mailer of the present invention may be either simplex or duplex printed with both variable and nonvariable information.

Figure 1:
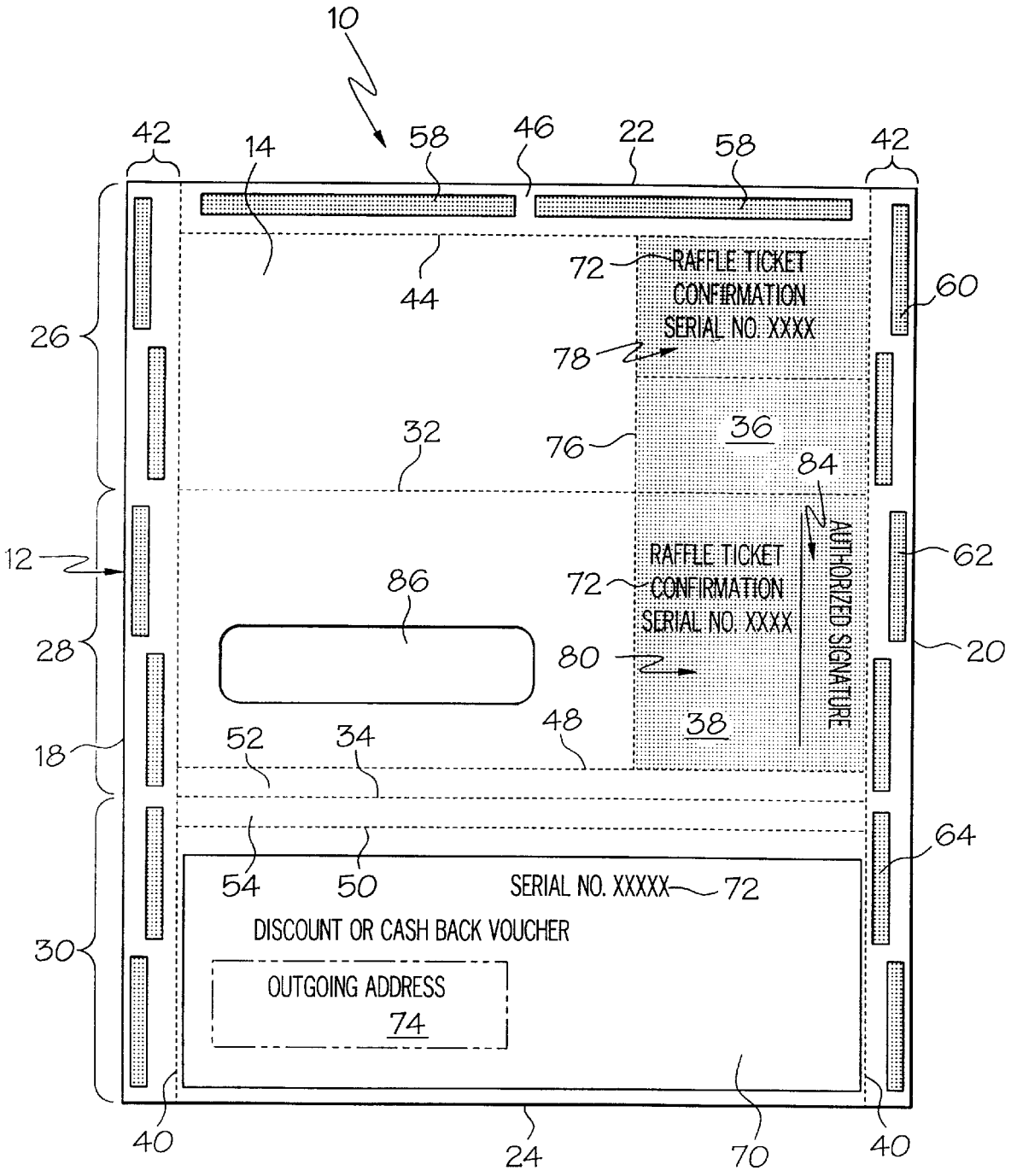
FIG. 1 is a plan view of a first face of a business form intermediate according to the present invention.
Figure 2:
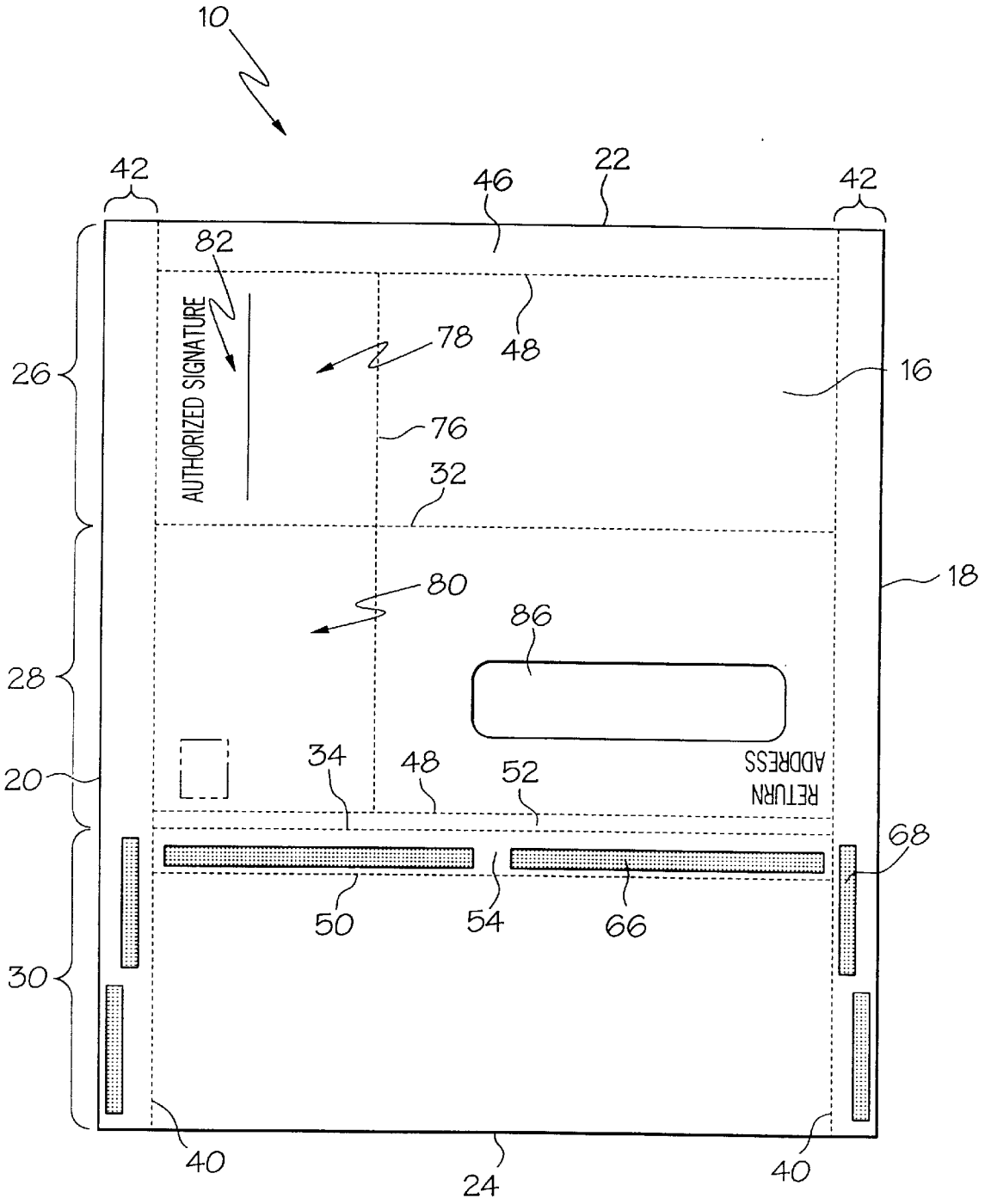
FIG. 2 is a plan view of a second, opposite face of the intermediate illustrated in FIG. 1.

Referring now to FIGS. 1 and 2, wherein like reference numerals refer to like parts, there is seen a mailer or form 10 of the present invention. Form 10 includes a substrate sheet 12 which may be of any known material common in the art for substrate purposes, such as paper of various weights, plastic or composite. Substrate sheet 12 includes a first face 14 and a second face 16, a first side edge 18, a second side edge 20, a first end 22 and a second end 24. First and second side edges 18 and 20, respectively, are opposite and parallel to each other. First and second end edges 22 and 24, respectively, also are opposite and parallel to one another.

Substrate 12 is divided into a first panel 26, a second panel 28 and a third panel 30 by a first fold line 32 and a second fold line 34, respectively. The fold lines 32, 34 may be lines of weakness, such as a partial die cut line or a line of perforations, to facilitate folding. Such a line of weakness 32 also makes it easier for the user to separate panels 26 and 28, should that be desired.

Substrate 12 has on its first face 14 a CB coating composition 36 and a CF coating composition 38. As used herein, the terms CB and CF have their wellunderstood meanings in this art. That is, a CB coating composition typically contains an encapsulated solution of color-forming leuco dyes. A CF coating composition typically contains dispersed particles of an acidic color-developing co-reactant. Preferably, CB coating composition 36 and CF coating composition 38 are compatible with laser printers (i.e., heat and pressure resistant).

CB coating composition 36 is disposed in first panel 26 in such a manner that when form 10 is folded about first fold line 32, CB coating composition 36 is in contact with CF coating composition 38. Both CB coating composition 36 and CF coating composition 38 may be provided in almost any shape and location on substrate 12, with the constraint that, when the form 10 is folded for imaging purposes, they are in contact with each other.

Substrate 12 may also be full or spot coated on one or both of the first and second faces, 14 and 16, with other specialty inks or coatings. Preferably, substrate 12 is a paper coated on first face 14 with a coating that enhances the bonding of toner images from various printers. These coatings make the image more durable. Toner adhesion enhancing coatings are known in the prior art and include those described in U.S. Pat. No. 5,045,426, the disclosure of which is hereby incorporated by reference.

First and second faces 14 and 16 of substrate 12 may be printed with variable or nonvariable information or both. Variable information varies from form to form, such as for example address or identification number information. Nonvariable information remains the same from form to form, such as for example return address information or the name of the issuing body or company. Faces 14 and 16 may be printed by means of printing systems such as laser, ink jet, thermal transfer, impact or various other printing systems. Form 10 may be provided in single sheet or continuous web formats. Furthermore, form 10 may be either simplex or duplex printed.

Longitudinal lines of weakness 40 are provided adjacent the first and second side edges 18 and 20, and running the entire length of substrate 12. Lines of weakness 40 define a marginal strip portions 42 between the lines of weakness 40 and the respective side edges, 18 and 20. Transverse line of weakness 44 may be provided adjacent first end 22, defining a tear-off strip portion 46. Transverse lines of weakness 48 and 50 adjacent to second fold line 34 define tear-off strip portions 52 and 54, respectively. Transverse lines of weakness 44, 48 and 50 extend between longitudinal lines of weakness 40.

Adhesive patterns may be provided on form 10 for converting it into a mailer 56 when it is folded at lines 32 and 34. While the adhesive used may be heat activated, e.g., an adhesive which adheres to other adhesive coated areas upon the application of heat and pressure, it is preferably a conventional pressure seal adhesive. Numerous heat activated and pressure activated adhesives may be used in the mailer of the present invention. On first face 14 a transverse adhesive pattern 58 is provided on tear-off strip portion 46. Longitudinal adhesive patterns 60, 62 and 64 are disposed on marginal strips 42 of first face 14 on first panel 26, second panel 28 and third panel 30, respectively. Second face 16 has transverse adhesive pattern 66 disposed on tear-off strip portion 54 and longitudinal adhesive patterns 68 on marginal strips 42 of third panel 30.

In this embodiment, third panel 30 may comprise a check, coupon or voucher portion 70 with an identifying indicia area 72 and an outgoing address area 74. It is contemplated by the present invention that outgoing address area 74 could also be provided in the first panel 26 of the second face 16. Form 10 includes a detachable portion, formed by vertical line of weakness 76 extending longitudinally through first panel 26 and second panel 28, longitudinal line of weakness 40 and transverse lines of weakness 44 and 48. The detachable portion preferably comprises a raffle ticket bisected by first fold line 32 into an original portion 78 and a copy portion 80. Each portion of the raffle ticket is provided with identifying indicia 72. An original signature area 82 is provided on second face 16 of the raffle ticket original portion 78. A corresponding copy signature area 84 is provided on first face 14 of the raffle ticket copy portion 80.

An address window 86 may also be provided on form 10. Address window 86 may be disposed in any of the first panel 26, the second panel 28 or the third panel 30. Address window 86 may be a cut-out opening in substrate 12 thereby allowing the outgoing address to be viewed. Alternatively, address window 86 may be covered by any one of a number of translucent or clear films well known in the art which will allow the outgoing address to be viewed, while protecting the substrate 12 beneath the plastic film.

Figure 3:
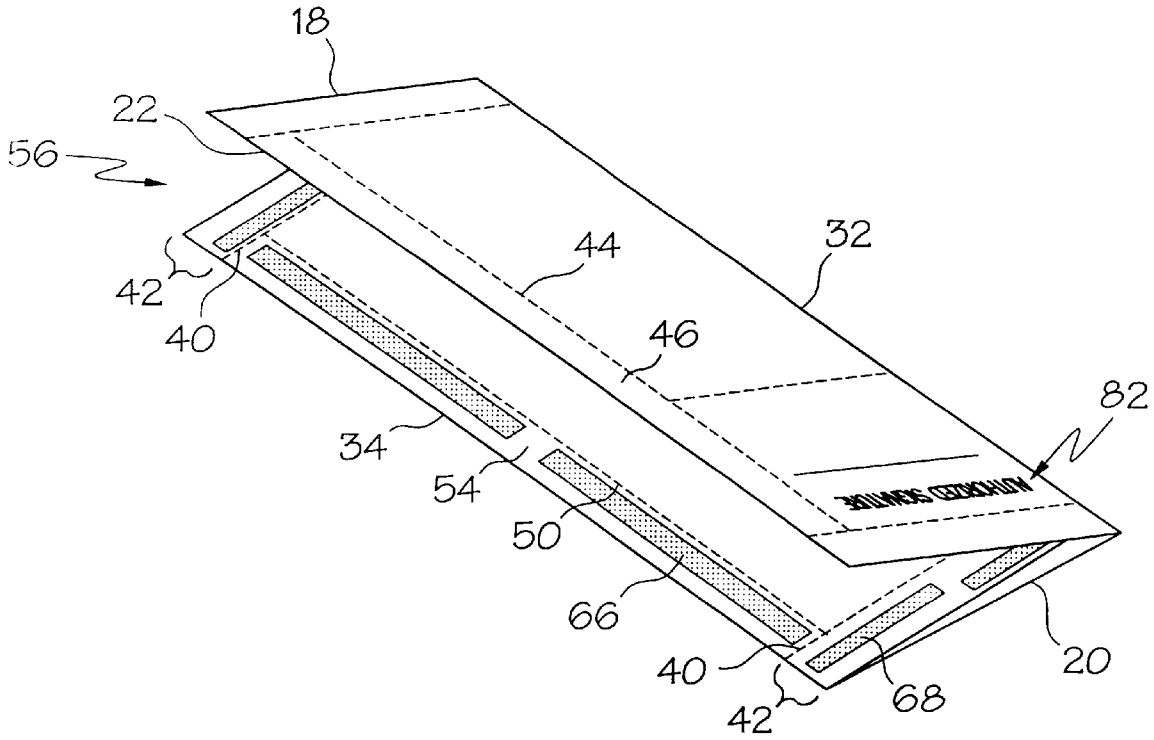
FIG. 3 is an isometric view of a business form according to the present invention formed by folding of the intermediate of FIGS. 1 and 2.

Referring now to FIG. 3 in conjunction with FIGS. 1 and 2, in order to fold the C-fold mailer 56 of the present embodiment, form 10 is folded about second fold line 34 to bring first face 14 of third panel 30 into contact with first face 14 of second panel 28. Next the form 10 is folded along the first fold line 32 to bring first face 14 of first panel 26 into contact with second face 16 of third panel 30. It will be appreciated that the areas of pressure seal adhesive will all come into contact with corresponding areas of adhesive on contacting panels. The areas of pressure seal adhesive are activated under application of pressure to provide fully sealed mailer 56.

The recipient opens the mailer by tearing along the lines of weakness 40, 44, 48 and 50 and removing marginal strips 42 and tear-off strips 46, 52, 54. Removing marginal strips 42 and tear-off strips 46, 52, 54 removes the adhesive securing mailer 56, thereby allowing easy access to the inside of the mailer 56. The recipient can then apply check, coupon or voucher portion 70 to the purchase or rental of a particular product. Furthermore, the raffle ticket can be used by tearing along vertical line of weakness 76 to remove the raffle ticket, and then folding it along first fold line 32 bringing CB composition 36 in contact with CF composition 38. A person authorized to accept the raffle ticket signs it in original signature area 82, causing CB coating composition 36 to react with CF coating composition 38 thereby transferring an image of the signature to copy signature area 84. The raffle ticket original portion 78 is submitted to the merchant, while the copy portion 80 is retained by the mailer recipient. It will be appreciated that the interposition of panel 30 between panels 26 and 28 has previously prevented any image transfer to copy signature area 84.

Figure 4:
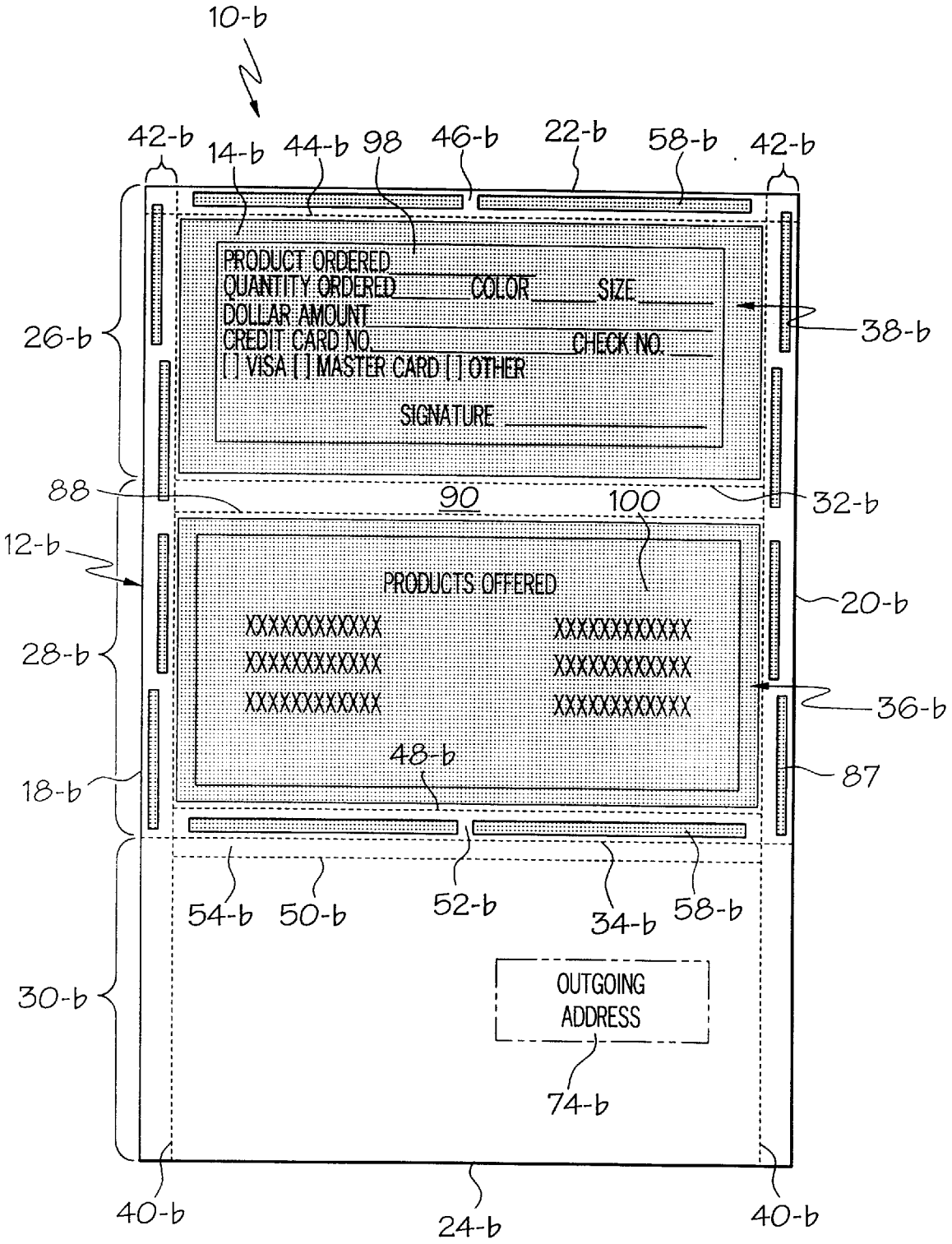
FIG. 4 is a plan view of a first face of a business form intermediate according to the present invention.
Figure 5:
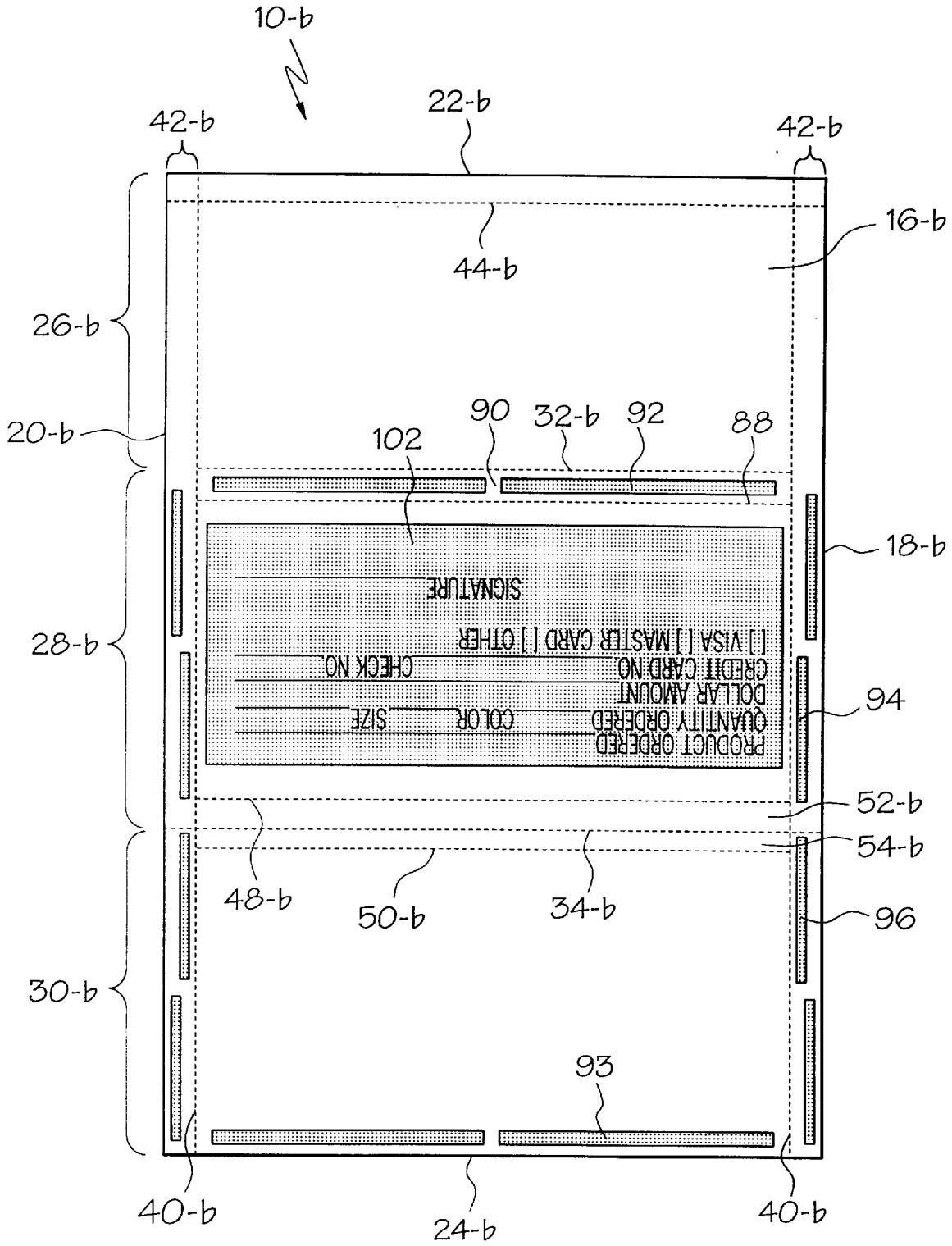
FIG. 5 is a plan view of a second, opposite face of the intermediate illustrated in FIG. 4.

Referring now to FIGS. 4 and 5, wherein like reference numerals refer to like parts, there is illustrated a second embodiment of the invention in a Z-fold configuration. In this embodiment, first face 14-*b* has transverse adhesive patterns 58-*b* disposed on tear-off portions 46-*b* and 52-*b*. Longitudinal adhesive pattern 87 is disposed on marginal strips 42-*b* of first face 14-*b* on second panel 28-*b*. Transverse line of weakness 88 adjacent to first fold line 32-*b* defines tear-off strip portion 90. Second face 16-*b* has transverse adhesive pattern 92 disposed on tear-off strip portion 90, transverse adhesive pattern 93 adjacent second end 24-*b* and longitudinal adhesive patterns 94 and 96 disposed on marginal strips 42-*b* on second panel 28-*b* and third panel 30-*b*, respectively.

In this embodiment, first panel 26-*b* first face 14-*b* of substrate 12-*b* is coated with CF coating composition 38-*b* and imprinted with copy order form indicia 98. Second panel 28-*b* first face is coated with CB coating composition 36-*b* and imprinted with product offering indicia 100. Second panel 28-*b* second face 16-*b* is imprinted with original order form indicia 102.

In order to form the Z-fold mailer of the present embodiment of the invention, form 10-*b* is folded about first fold line 32-*b* to bring first face 14-*b* of first panel 26-*b* into contact with first face 14-*b* of second panel 28-*b*, and then along second fold line 34-*b* to bring second face 16-*b* of third panel 30-*b* into contact with second face 16-*b* of second panel 28-*b*. Corresponding areas of pressure seal adhesive on adjacent panels come in contact forming a seal under pressure to provide fully sealed mailer 104.

Alternatively, the Z-fold mailer of the present embodiment of the invention may be formed by folding form 10-*b* about first fold line 32-*b* to bring second face 16-*b* of first panel 26-*b* into contact with second face 16-*b* of second panel 28-*b*, and then along second fold line 34-*b* to bring first face 14-*b* of third panel 30-*b* into contact with first face 14-*b* of second panel 28-*b*. As would be appreciated by those practicing the present invention, particularly in light of the detail illustrated in FIGS. 4 and 5, the specific locations of the various adhesive patterns would have to be repositioned accordingly to facilitate creation of a viable Z-fold mailer. Further, the location of the outgoing address panel would have to be repositioned accordingly such that it would be viewed from an exterior surface of the mailer or through a window or a transparentized viewing area formed in an exterior surface of the mailer. In the Z-fold mailer formed according to this alternative procedure, the first panel 26-*b* first face 14-*b* of substrate 12-*b* coated with CF coating composition 38-*b* and the second panel 28-*b* first face coated with CB coating composition 36-*b* are folded away from each other to prevent inadvertent creation of a duplicate image.

The recipient opens the mailer by tearing first along lines of weakness 40-*b* to remove marginal strips 42-*b* and then along lines of weakness 44-*b*, 48-*b* and 50-*b* to remove tear-off strips 46-*b*, 52-*b*, 54-*b*. Third panel 30-*b* is removed by breaking the bond between transverse adhesive patterns 92 and 93. Although, patterns 92 and 93 are shown as strips of adhesive, they may alternatively be configured as dots, squares, or other discontinuous arrangements to enhance the ease by which they may be separated. First panel 26-*b* and second panel 28-*b* comprise a two-part composite which can be filled out by the recipient for ordering products by return mail. The recipient folds the two-part form along first fold line 32-*b* bringing CB coating composition 36-*b* in contact with CF coating composition 38-*b*. When the recipient fills in the data entry areas corresponding to the original order form indicia 102 the same information is transferred to the first panel first face in registration with copy order form indicia 98. Original order form indicia 102 is mailed back to the direct mail merchant and copy order from indicia 98 is retained for the recipient's records.

Figure 6:
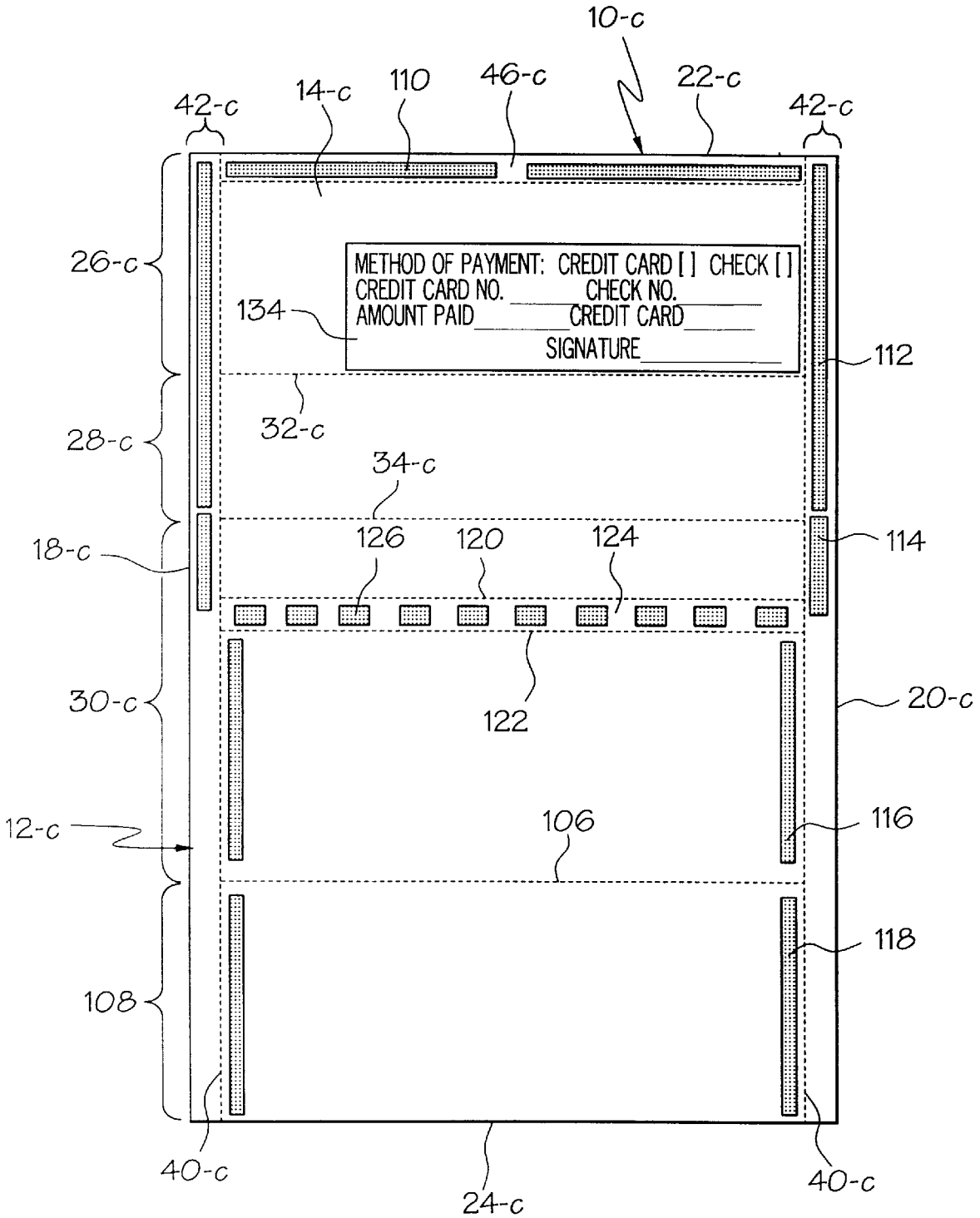
FIG. 6 is a plan view of a first face of a business form intermediate according to the present invention.
Figure 7:
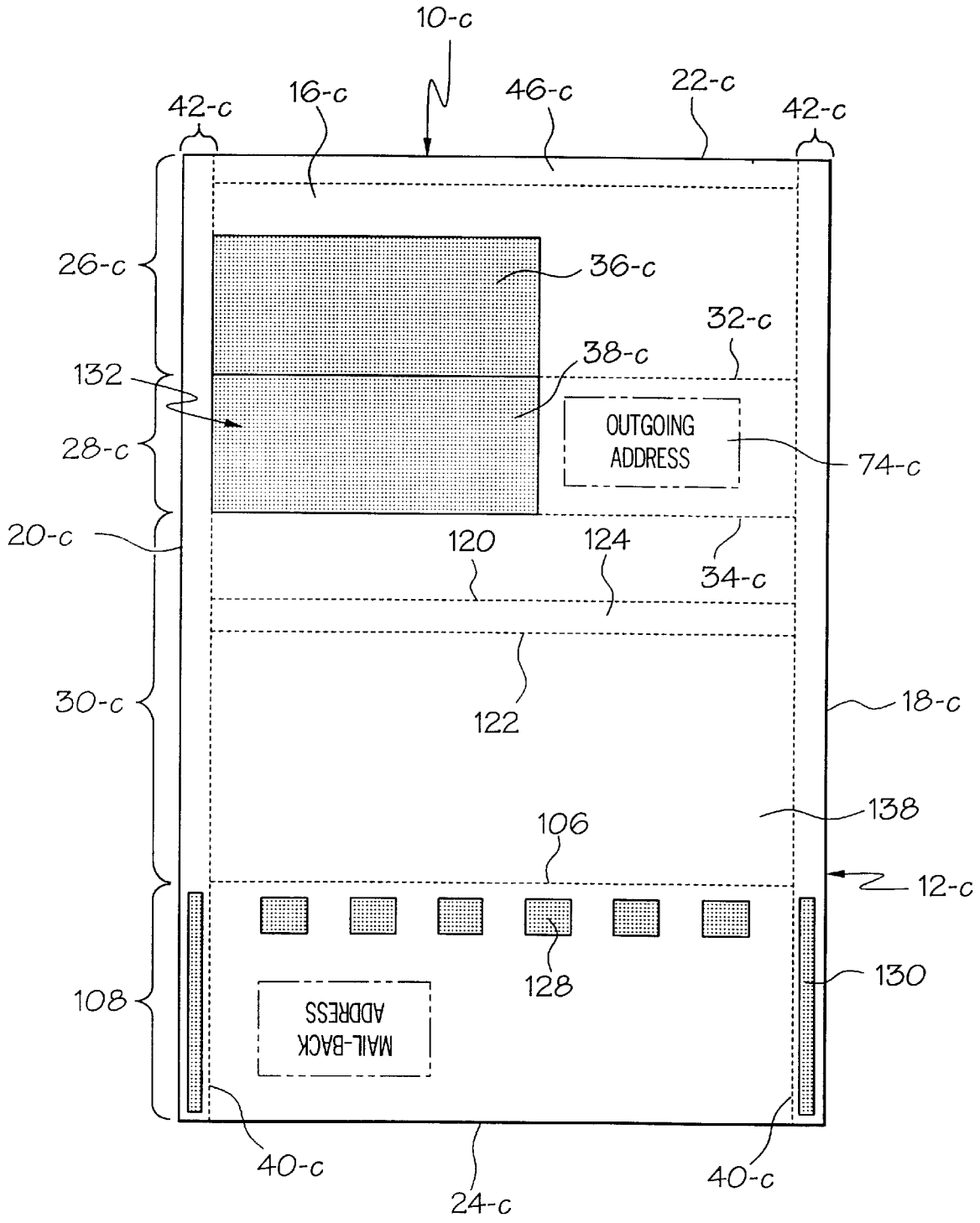
FIG. 7 is a plan view of a second, opposite face of the intermediate illustrated in FIG. 6.

Referring now to FIGS. 6 and 7, wherein like reference numerals refer to like parts, there is illustrated a third embodiment of the invention comprising a C-fold configuration with a return envelope. In this embodiment, third fold line 106 further divides substrate 12 and defines fourth panel 108. First face 14-*c* has transverse adhesive pattern 110 disposed on tear-off portion 46-*c*. Longitudinal adhesive patterns 112, 114 are disposed on marginal strips 42-*c* of first face 14-*c*. Longitudinal adhesive pattern 112 is on first panel 26-*c* and second panel 28-*c*; longitudinal adhesive pattern 114 is on third panel 30-*c*. Longitudinal adhesive patterns 116, 118 lie inwardly adjacent to lines of weakness 40-*c* on third panel 30-*c* and fourth panel 108. Transverse lines of weakness 120,122 define return envelope flap 124. A strip of rewettable adhesive 126 is disposed on return envelope flap 124. Rewettable adhesive 126 is preferably applied as a discontinuous strip. With the exception of the strip of adhesive 126, the adhesive patterns used in this embodiment are preferably pressure activated adhesive, although thermal activated adhesive may alternatively be used.

Second face 16-*c* has transverse adhesive pattern 128 disposed on fourth panel 108 adjacent third fold line 106. Adhesive pattern 128 is preferably applied as a discontinuous strip. Longitudinal adhesive pattern 130 is disposed on marginal strips 42-*c* on fourth panel 108.

In this embodiment, first panel 26-*c* second face 16-*c* of substrate 12-*c* is coated with CB coating composition 36-*c*. Second panel 28-*c* second face is coated with CF coating composition 38-*c* and may also include an outgoing address area 74-*c*. Second panel 28-*c* second face 16-*c* may further comprise a payment receipt 132. The receipt 132 may be blank, as shown, or may be preprinted with indicia corresponding to data entry areas for the customer's name, method of payment, payment amount and signature. First panel 26-*c* further comprises a return stub 134 wherein the preprinted indicia directing the recipient to fill in method of payment, payment amount and signature is disposed on first face 14-*c* such that return stub 134 is in registration with payment receipt 132 when folded about first fold line 32-*c*.

In order to form the C-fold mailer of the present embodiment of the invention, form 10-*c* is folded about third fold line 106 to bring first face 14-*c* of fourth panel 108 into contact with first face 14-*c* of third panel 30-*c*, and then along second fold line 34-*c* to bring first face 14-*c* of first and second panels 26-*c*, 28-*c* into contact with first face 14-*c* of the upper portion of third panel 30-*c* and second face 16-*c* of fourth panel 108. Corresponding areas of pressure seal adhesive on adjacent panels come in contact, forming a seal under pressure to provide fully sealed mailer.

The recipient opens the mailer by tearing first along lines of weakness 40-*c* to remove marginal strips 42-*c* and then carefully separating first panel 26-*c* from fourth panel 108 by breaking the bond between transverse adhesive patterns 110 and 128 and removing tear-off strip 46-*c*. Third panel 30-*c* and fourth panel 108 remain sealed at the bonds formed by the activation of longitudinal adhesive patterns 116 and 118 forming a return envelope pocket. Tearing along transverse line of weakness 120 removes return envelope 138 from the remainder of the form.

First panel 26-*c* and second panel 28-*c* comprise a two-part composite return stub 134 and payment receipt 132. The recipient folds the two-part form along first fold line 32-*c* bringing CB coating composition 36-*c* in contact with CF coating composition 38-*c*. When the recipient fills in the data entry areas corresponding to return stub 134 the same information is transferred to the second panel second face in registration with payment receipt 132. Return stub 134 and the payment are inserted into the pocket of return envelope 138 and return envelope flap 124 may be folded about line of weakness 122 such that the rewettable adhesive 126 registers with the fourth panel 108 second face 16-*c* whereby the return envelope can be sealed. Payment receipt 132 is retained for the recipient's records.

Referring now to FIGS. 8–11, wherein like reference numerals refer to like parts, there is illustrated a fourth embodiment of the invention comprising a multi-ply mailer 139 with a fold-over carbonless insert 141 and a return envelope. This embodiment of the invention includes a first ply 140 with first face 142 and second face 144. First ply 140 preferably comprises an address area 146 on first face 142 and an image transferring means 148 on second face 144. The image transferring means 148 is preferably a carbonizing coating so as to transfer indicia to one or more underlying plies when subjected to an imaging force.

Mailer 139 also comprises a second ply 150, the first and second plies 140, 150 being adhesively attached together by glue lines 152, 154 along the side edges to form an outgoing mailer front and back, respectively. First and second plies 140, 150 have substantially the same length and width dimensions. Second ply 150 has a first line of weakness 156 defining a return envelope flap 158 along one of the side edges. A strip of rewettable adhesive 126-*d* is disposed on return envelope flap 158. It will be understood that, with the exception of rewettable adhesive 126-*d*, the balance of the adhesive patterns are preferably pressure activated adhesive, but may alternatively comprise thermal activated adhesive. A first insert ply 160 has substantially the same length dimension and typically lesser width dimension than first and second plies 140, 150. First insert ply 160 is adhesively attached to second ply 150 by glue line 162, a second glue line adjacent the lower edge (not shown), glue line 166, and by correspondingly positioned glue lines on ply 160, forming a return envelope.

Referring further to FIGS. 8–11, the structure of the fold-over carbonless insert 141 is described in detail. A substrate 12-*d* having a first face 14-*d* and a second face 16-*d* further comprises a fold line 170 separating substrate 12-*d* into a first portion 172 and a second portion 174. Fold line 170 is preferably a line of weakness. A CB coating composition 36-*d* is disposed on first portion 172 and a CF coating composition 38-*d* is disposed on second portion 174 such that when substrate 12-*d* is folded about fold line 170, CB composition 36-*d* is in contact with CF coating composition 38-*d*. The substrate 12-*d*, folded over in this manner forms second and third insert plies 176, 178 of mailer 139. Second and third insert plies 176, 178 have lesser dimensions than plies 140, 150 and are located in the envelope pocket formed by first ply 140 and first insert ply 160. First ply 140 is releasably attached to the upper surface of first insert 160 by any suitable means such as by crimps or by releasable glue or the like. Preferably, discontinuous strips of releasable glue 161 are used.

Mailer 139 also includes longitudinal lines of weakness 40-*d* defining marginal strip portions 42-*d* on each of plies 140, 150, 160 and 176 adjacent the left edges thereof, as well as additional lines of weakness 40-*d* defining marginal strip portions 42-*d* on plies 140 and 150 along the right edge. Marginal strip portions 42-*d* are provided with feed holes 180.

Figure 8:
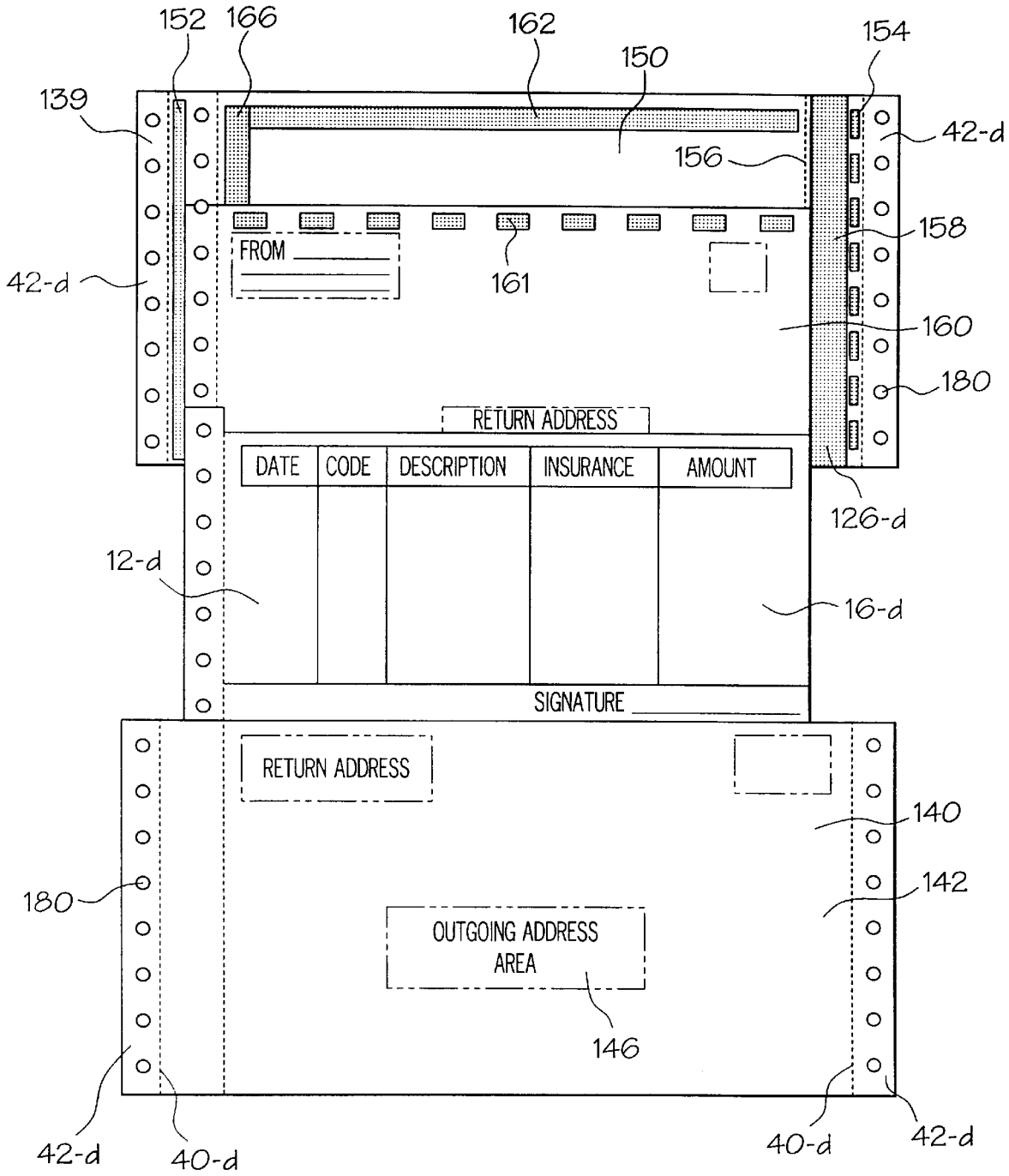
FIG. 8 is an exploded perspective view from above of a mailer according to the present invention.
Figure 9:
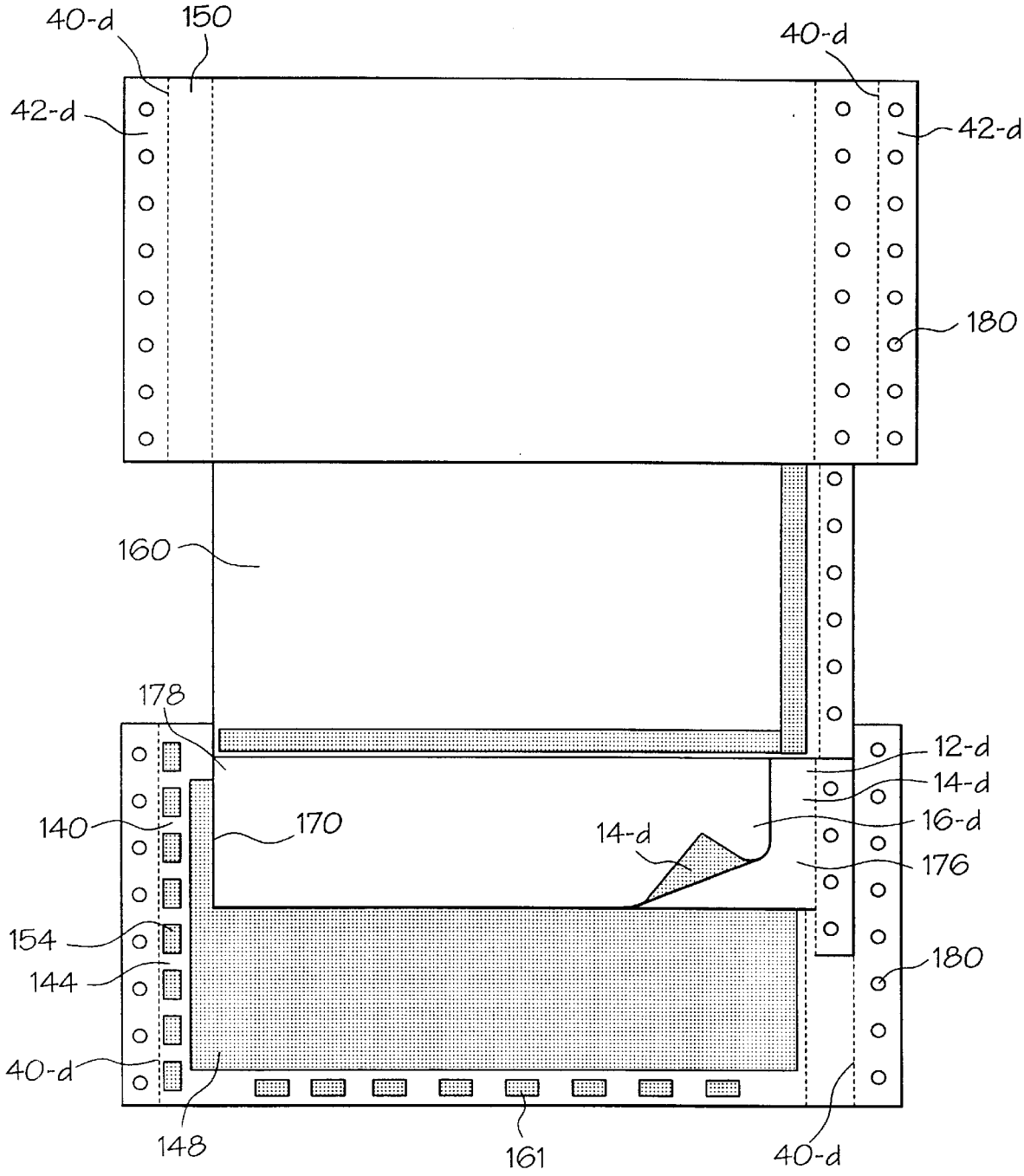
FIG. 9 is an exploded view from below of the mailer illustrated in FIG. 8.
Figure 10:
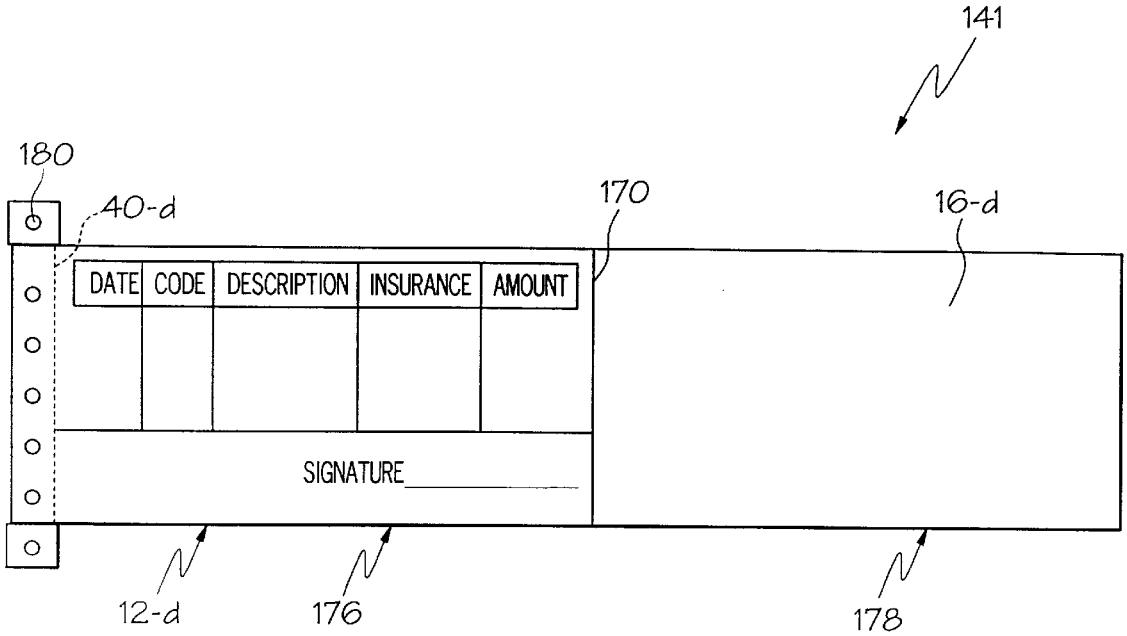
FIG. 10 is a top plan view of a fold-over carbonless insert from the mailer illustrated in FIG. 8.
Figure 11:
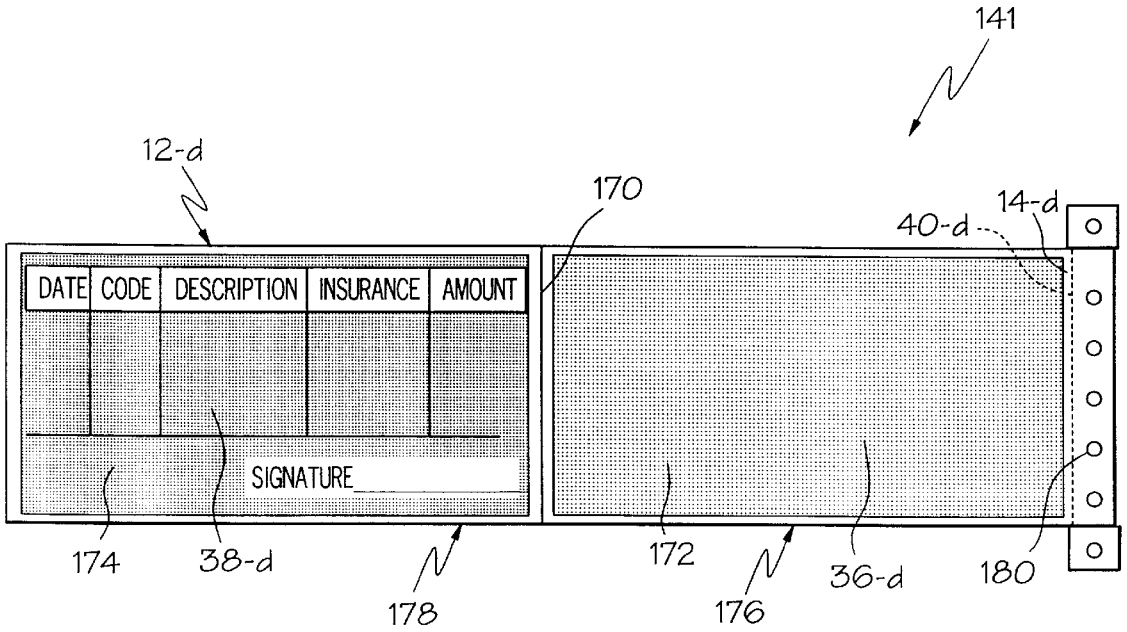
FIG. 11 is a bottom plan view of the fold-over carbonless insert illustrated in FIG. 10.
Figure 12:
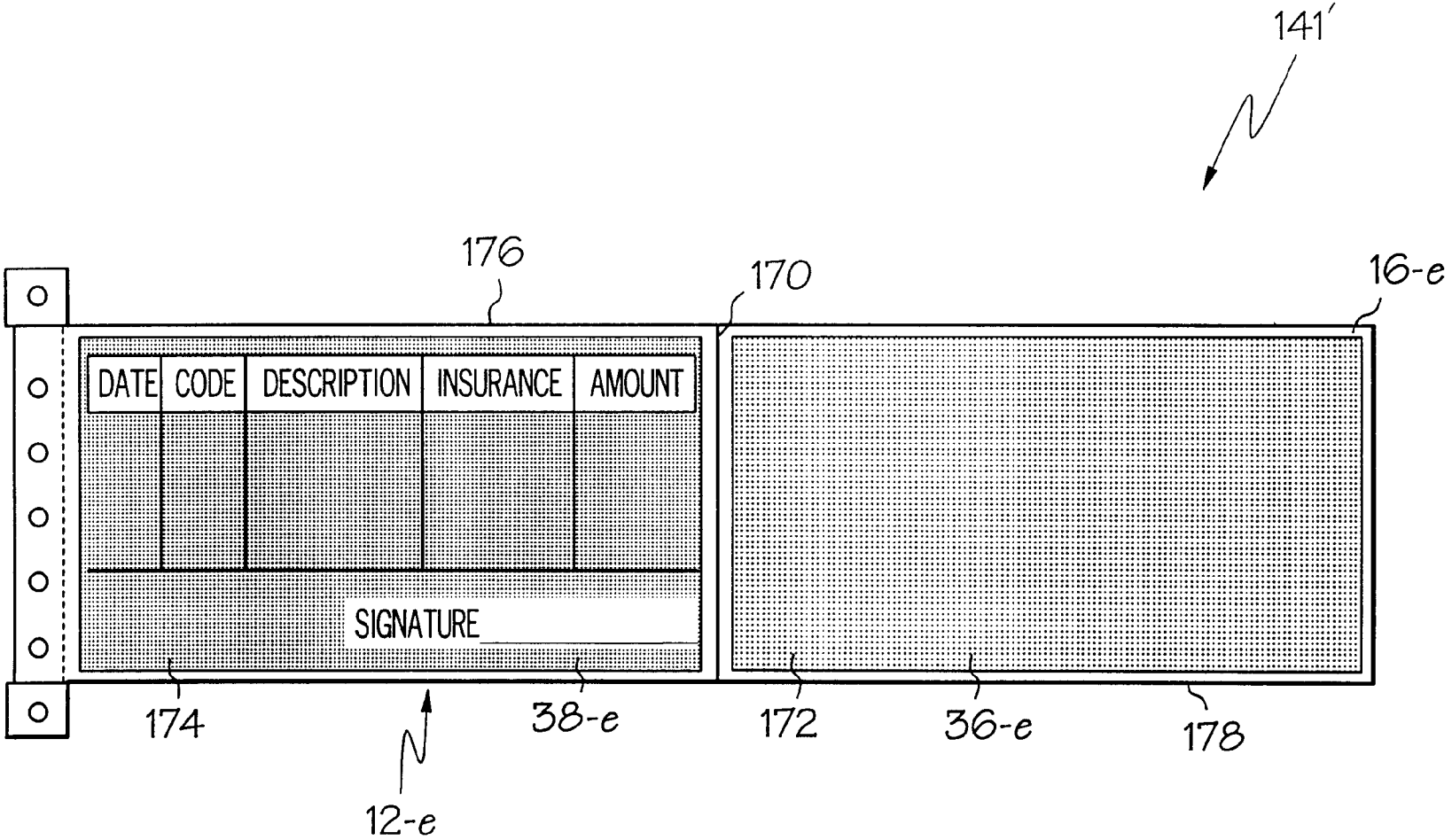
FIG. 12 is an illustration of an alternative fold-over carbonless insert according to the present invention.

Referring now to FIG. 12 of the present invention, an alternative fold-over carbonless insert 141' for use in the mailer 139 of FIGS. 8 and 9, is described. A substrate 12-*e* having a first face (not shown) and a second face 16-*e* further comprises a fold line 170 separating substrate 12-*e* into a first portion 172 and a second portion 174. A CB coating composition 36-*e* is disposed on first portion 172 and a CF coating composition 38-*e* is disposed on second portion 174 such that when substrate 12-*e* is folded about fold line 170, CB composition 36-*e* is not in contact with CF coating composition 38-*e*. The substrate 12-*e*, folded over in this manner forms second and third insert plies 176, 178 of mailer 139. Since the CB and CF panels face away from each other, no inadvertent carbonless imaging will occur when carbon impressions are made from first ply 140 of the mailer 139, see FIGS. 8 and 9.

Figure 13:
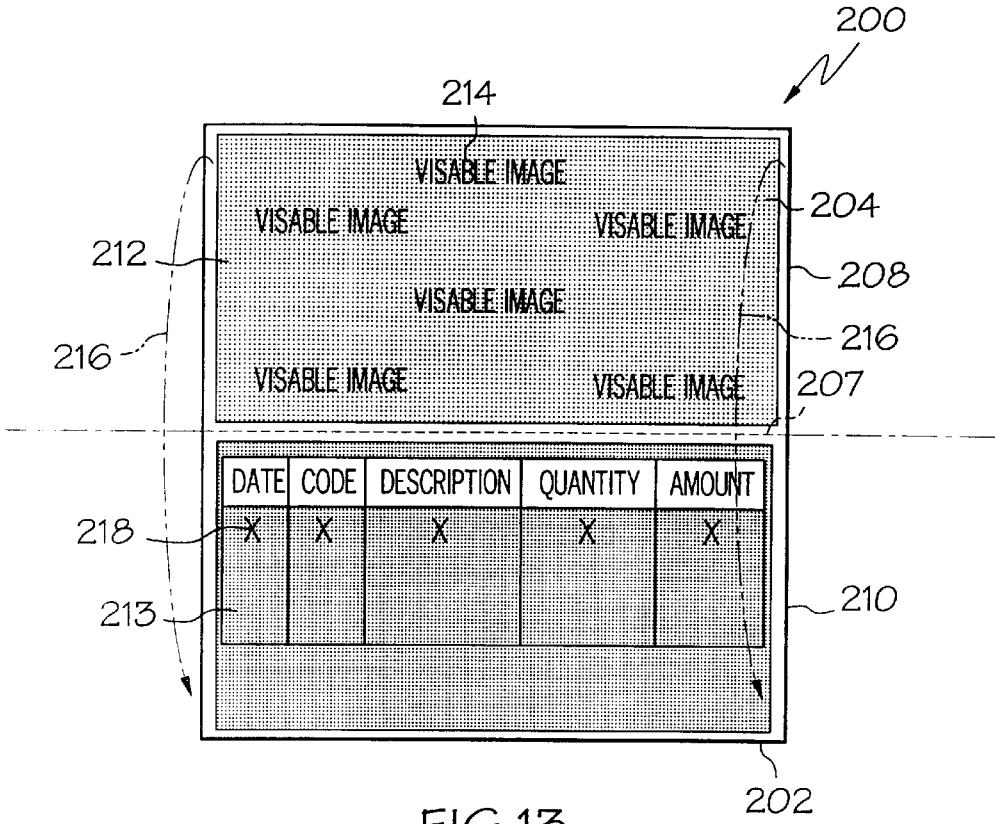
FIGS. 13 and 14 are front and back plan views of a carbonless business form according to the present invention.
Figure 14:
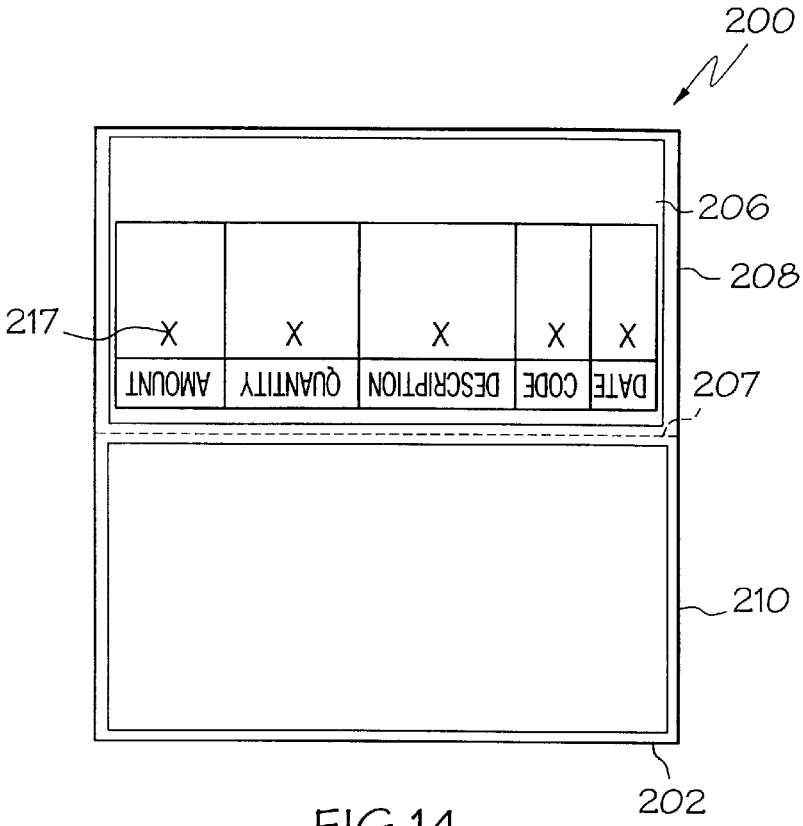

Referring now to FIGS. 13 and 14 of the present invention, where like reference numerals refer to like structure, a carbonless business form 200 according to the present invention is illustrated. The business form 200 comprises a substrate 202 having a first face 204 and a second face 206. A fold line 207 is provided across the substrate 202 and separates the substrate into a first portion 208 and a second portion 210. A CB coating composition 212 is provided on the first portion 208 of the first face 204. A CF coating composition 213 is provided on the second portion 210 of the first face 204. An image medium 214 is provided on the first portion 208 of the first face 204. As is clearly illustrated in FIG. 13, the image medium 214 and the CB coating 212 occupy a common area of the first portion 208 of the first face 204. The image medium 214 may be any of a number conventional mediums, including those selected from the group consisting of a toner image, an ink jet image, a carbon image, a pigmented ribbon image, a thermal transfer image, and combinations thereof.

The CB coating composition 212, the CF coating composition 213, the image medium 214, and the fold line 207 are positioned such that the image medium 214 is interposed between at least a portion of the CB coating composition 212 and at least a portion of the CF coating composition 213 when the substrate 202 is folded about the fold line 207 in a first direction 216. The CB coating composition 212, the CF coating composition 213, and the fold line 207 are positioned such that, upon folding the substrate 202 about the fold line 207 in the first direction 216, and upon introduction of an original image 217 with an imaging force on the second face 206 of the substrate 202, a duplicate image 218 is formed in at least a portion of the CF coating composition 213 on the second portion 210 of the first face 204. The image medium 214 interposed between the CB coating composition 212 and the CF coating composition 213 does not interfere with creation of a legible duplicate image 218. Specifically, the duplicate image 218 may be created on the second portion 210 of the first face 204 even though the image medium 214 and the CB coating 212 occupy a common area of the first portion 208 of the first face 204. As will be appreciated by those practicing the present invention, the stated common area occupied by the image medium 214 and the CB coating 212 is positioned opposite the duplicate image 218 formed on the second portion 210 of the first face 204.

Referring further to the embodiment of the present invention illustrated in FIGS. 13 and 14, it is contemplated that the business form 200 may be utilized to form a V-fold mailer by providing appropriately positioned adhesive patterns in marginal portions of the second face 206, by providing an appropriately positioned outgoing address area in or on the business form, and by folding the substrate 202 about the fold line 207 in a direction opposite the first direction 216. In this manner, the CB coating composition 212 and the CF coating composition 213 are kept from contacting each other in the mailing process. The recipient may then re-fold the substrate 202 about the fold line 207 in the first direction 216 to enable formation of the duplicate image 218.

Having described the invention in detail and by reference to the preferred embodiments thereof, it will be apparent that modifications and variations are possible without departing from the scope of the invention which is defined in the appended claims.

What is claimed is:

1. A business form comprising:

a substrate having first and second faces, first and second end edges, and first and second side edges;

first, second, and third fold lines in said substrate, parallel to said end edges, and dividing said substrate into first, second, third, and fourth panels, said first panel being positioned between said first end edge and said first fold line, said third panel being positioned between said second fold line and said third fold line, said fourth panel being positioned between said third fold line and said second end edge, and said second panel being positioned between said first and third panels:

adhesive patterns associated with said panels for forming a mailer from said business form;

a CB coating composition on at least a portion of said second face;

a CF coating composition on at least a portion of said second face, wherein when said substrate is folded along one of said first and second fold lines, said CB coated portion comes in contact with said CF coated portion, wherein when said business form is folded about said third fold line, said fourth panel first face engages said third panel first face, and wherein when said business form is folded about said second fold line, said first and second panels first faces engage said fourth panel second face and a portion of said third panel first face.

2. A business form as claimed in claim 1 further comprising cooperative adhesive patterns on said third panel first face and said fourth panel first face for forming edges of an enclosed pocket of a return envelope when said business form is folded into said mailer.

3. A business form as claimed in claim 2 further comprising means for forming said business form into a return envelope, comprising first and second lines of weakness disposed parallel to said end edges and defining a return envelope flap portion on said third panel.

4. A business form as claimed in claim 3 further comprising a strip of rewettable adhesive for sealing said return envelope.

5. A business form as claimed in claim 4 wherein said strip of rewettable adhesive is discontinuous.

6. A business form as claimed in claim 1 wherein said CB coating composition is disposed on said first panel second face and said CF coating composition is disposed on said second panel second face, such that when said business form is folded about said first fold line said CB coating composition comes in contact with said CF coating composition.

7. A business form as claimed in claim 6 further comprising an outgoing address area on said first or second panel second face.

* * * * *